US012623271B2

(12) United States Patent
Gnutti et al.

(10) Patent No.: US 12,623,271 B2
(45) Date of Patent: May 12, 2026

(54) APPARATUS FOR MECHANICAL MACHINING BY PLASTIC DEFORMATION OR FOR ASSEMBLING A PAIR OF COMPONENTS, AND RELATIVE MACHINE TOOL COMPRISING SUCH AN APPARATUS

(71) Applicant: Gnutti Transfer S.p.A., Ospitaletto BS (IT)

(72) Inventors: Renato Gnutti, Ospitaletto BS (IT); Stefano Coraglia, Ospitaletto BS (IT)

(73) Assignee: Gnutti Transfer S.p.A., Ospitaletto BS (IT)

( * ) Notice: Subject to any disclaimer, the term of this patent is extended or adjusted under 35 U.S.C. 154(b) by 370 days.

(21) Appl. No.: 18/226,323

(22) Filed: Jul. 26, 2023

(65) Prior Publication Data

US 2024/0033807 A1 Feb. 1, 2024

(30) Foreign Application Priority Data

Jul. 27, 2022 (IT) ..... 102022000015924

(51) Int. Cl.
*B21D 51/16* (2006.01)

(52) U.S. Cl.
CPC ..... *B21D 51/16* (2013.01)

(58) Field of Classification Search
CPC ..... B21D 51/16; B21D 39/04; B21D 39/046
See application file for complete search history.

(56) References Cited

FOREIGN PATENT DOCUMENTS

| | | | |
|---|---|---|---|
| CN | 109127930 | | 1/2019 |
| CN | 110842093 | | 2/2020 |
| EP | 2781816 | | 9/2014 |
| JP | 01113139 A | * | 5/1989 |
| JP | H01113139 | | 5/1989 |
| KR | 101589623 | | 1/2016 |

OTHER PUBLICATIONS

English translation JP01113139 (Year: 1989).*
Search report dated Mar. 21, 2023; Application No. IT 102022000015924; 10 pages.

* cited by examiner

*Primary Examiner* — Jason L Vaughan
*Assistant Examiner* — Amanda Kreiling
(74) *Attorney, Agent, or Firm* — Rankin Hill & Clark, LLP; Erik J. Overberger

(57) ABSTRACT

An apparatus for mechanical machining by plastic deformation, comprising:

a support unit configured to support a workpiece;

a first and a second punch which are opposite and movable to and from the support unit along a direction of action to switch between an operating position in which they exert a pair of compression forces adapted to plastically deform the workpiece and a resting position in which they are spaced apart from the support unit, said pair of compression forces generating a pair of reaction forces opposite to themselves;

actuation members adapted to control the movement of the first and the second punch to and from the support unit along a direction of action;

a floating element adapted to support the first and the second punch from opposite sides of the support unit along the direction of action and configured to receive said reaction forces.

10 Claims, 9 Drawing Sheets

APPARATUS FOR MECHANICAL MACHINING BY PLASTIC DEFORMATION OR FOR ASSEMBLING A PAIR OF COMPONENTS, AND RELATIVE MACHINE TOOL COMPRISING SUCH AN APPARATUS

TECHNICAL FIELD

The present invention relates to an apparatus for mechanical machining by plastic deformation or for assembling a pair of components.

An object of the present invention is also a machine tool for mechanical machining by plastic deformation or for assembling a pair of components comprising the aforementioned apparatus.

The present invention can be usefully employed in the field of mechanical machining for plastic deformation, for example, for the realization of ducts with circumferential bulges or fittings.

Furthermore, the present invention can be employed in operations of mechanically assembling and fitting a pair of components, in particular for realizing interference couplings.

STATE OF THE ART

Machine tools for forming variable section ducts are known in the state of the art.

For example, DE2110758A1 and EP0649689A1 disclose machine tools for plastic deformation machining suitable for making fittings such as sleeves for connecting pipes or ducts.

In detail, said machines comprise a mould adapted to receive a tube to be deformed and a pair of punches configured to exert compression forces at opposite ends of said tube, so as to plastically deform it on the mould.

The intensity of the forces exerted by the punches depends on several factors, including the geometric characteristics and the material of the tube to be deformed.

It should be noted that, according to the third principle of dynamics (principle of action-reaction), the forces exerted by the punches generate opposite reaction forces that are discharged to the ground by means of special elements of feedback and support of the punches.

Given the significant intensity of the forces exerted by the punches, and consequently of the reaction forces, machine tools of the type disclosed above require important feedback elements, which significantly increase the size and weight of the machine tool itself.

In addition, the need to create feedback and support elements for punches of important dimensions and masses renders incompatible the integration of the aforementioned plastic deformation technologies in machine tools with automatic piece transfer, more commonly referred to as transfer machines. In this regard, it should be noted that the important size of the aforementioned feedback and support elements contrasts with the need for transfer machines to support a plurality of processing stations in spaces as contained as possible.

SUMMARY OF THE INVENTION

In this context, the technical task underlying the present invention is to propose an apparatus for mechanical machining by plastic deformation or for assembling a pair of components and a relative machine tool that overcomes the drawbacks of the prior art mentioned above.

In particular, it is an object of the present invention to provide a small-sized apparatus for mechanical machining by plastic deformation or for assembling a pair of components.

In particular, it is an object of the present invention to provide an apparatus for mechanical machining by plastic deformation or for assembling a pair of components that can be integrated in a machine tool with automatic transfer of the piece.

Advantages of the Invention

The apparatus that is the object of the present invention solves the aforementioned technical problem in that it comprises a floating element adapted to support a first and a second punch configured to exert compression forces on a workpiece or on a pair of components to be assembled.

Advantageously, the floating element is configured to receive the reaction forces arising from the operating of the compression forces which, being equal in modulus and orientation but opposite in direction, cancel on the floating element itself and do not need to be discharged to the ground.

It is therefore evident that by doing so it is possible to avoid the use of feedback elements of important dimensions and masses for the discharge of the reaction forces to the ground. Therefore, the apparatus that is the object of the present invention has a reduced size and can be integrated in a machine with automatic transfer of the piece.

LIST OF FIGURES

Further features and advantages of the present invention will become clearer from the indicative, and therefore non-limiting, disclosure of an apparatus for mechanical machining by plastic deformation or for assembling a pair of components and a related machine tool, as illustrated in the accompanying drawings, wherein.

DETAILED DESCRIPTION

With reference to the accompanying Figures, the present invention relates to an apparatus 1 that can be employed both for plastic deformation and for assembling a pair of components.

In the context of the present invention "mechanical machining by plastic deformation" refers to all types of processing that involve mechanical loads to induce plastic deformations in the workpiece to be processed, i.e. that remain when loads cease.

Furthermore, in the context of the present invention, the term "assembling" is intended to indicate the mechanical operation of joining two or more components, preferably, but not necessarily, by carrying out an interference coupling. For example, the apparatus that is the object of the present invention can be employed for fitting shafts, bushings, tongues or bearings in respective holes or openings specially dimensioned to carry out an interference coupling with these. For the definition of interference coupling, see the well-known theory of dimensional tolerances.

In general, the apparatus 1 that is the object of the present invention can be employed in all those processing or mechanical operations that require the application of a pair of compression forces.

With reference to FIGS. 1-7, the apparatus 1 includes a support unit 2 configured to support a workpiece P, when the apparatus 1 is employed for mechanical machining by plastic deformation, and at least one of the components to be assembled when the apparatus 1 is employed for assembling operations.

In a possible embodiment, the support unit 2 is configured to support at least two components to be assembled by aligning them along a coupling direction.

For the sake of simplicity, the following will refer exclusively to the workpiece P, however what has been said in relation to the latter also applies to the at least one component to be assembled.

In detail, with reference to FIG. 2, the support unit 2 has a first side 2A and a second side 2B opposite to the first 2A along a direction of action X-X that will be further disclosed below.

Preferably, the support unit 2 is configured to support the workpiece P by arranging it between the first and second sides 2A, 2B.

The apparatus 1 that is the object of the present invention further comprises a first and second punch 3, 4 adapted to impart respective pushing actions on the workpiece P.

Figure 1:
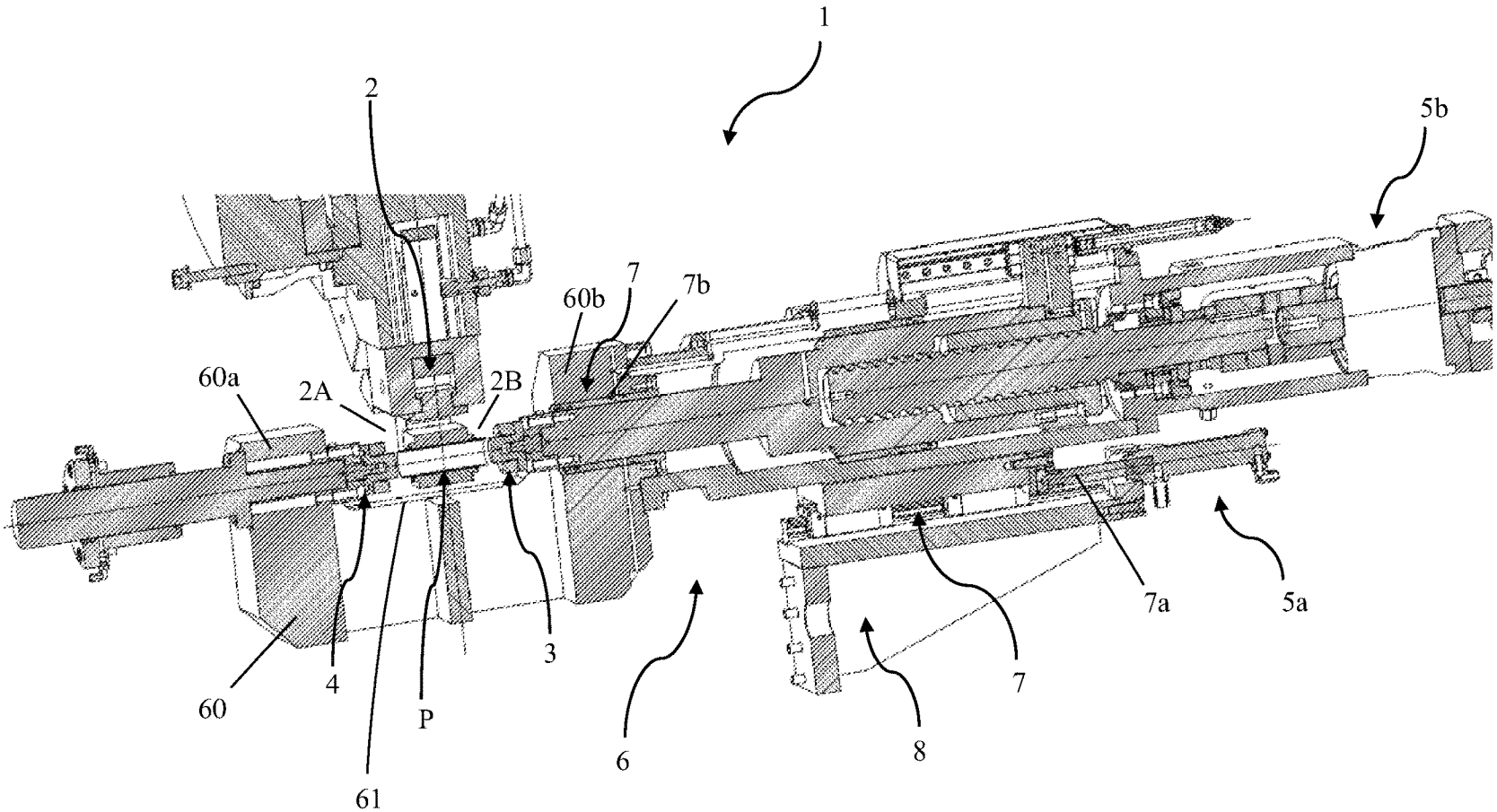
FIG. 1 shows a perspective sectional view of an apparatus according to the present invention shown in a resting position.
Figure 2:
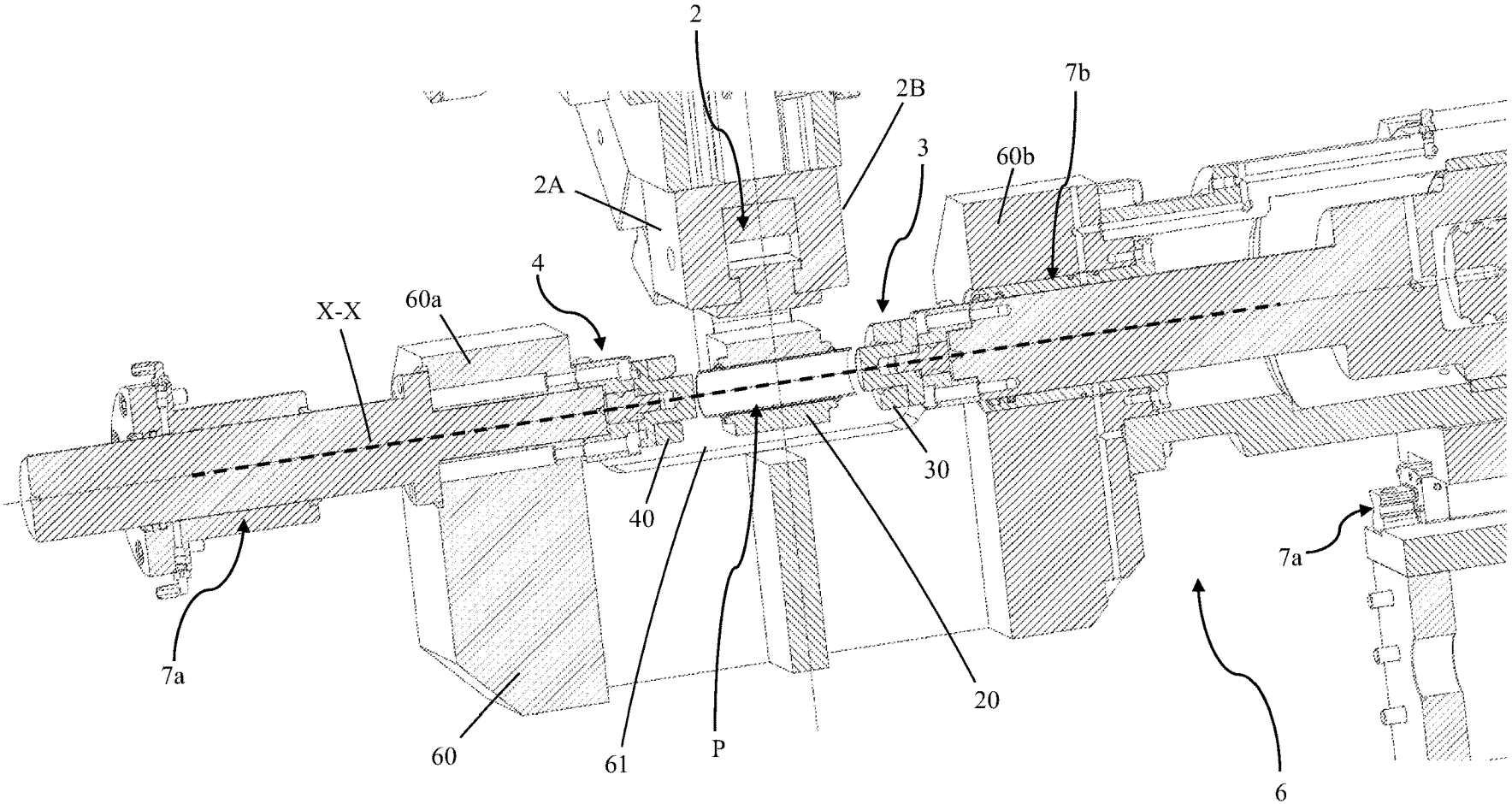
FIG. 2 shows a magnification of FIG. 1 to better highlight some technical details.

With reference to FIGS. 1 and 2, the first and second punches 3, 4 are opposite and arranged on opposite sides of the support unit 2.

In detail, the first and second punches 3, 4 face, respectively, the first and second sides 2A, 2B of the support unit 2, thus being arranged on opposite sides of the workpiece P. In particular, each punch 3, 4 is associated with an end portion of the workpiece P.

The first and the second punch 3, 4 are movable from and toward the support unit 2 along a direction of action X-X to switch between an operating position in which they exert a pair of compression forces F1, F2 adapted to plastically deform the workpiece P and a resting position in which they are spaced apart from the support unit 2.

Figure 5:
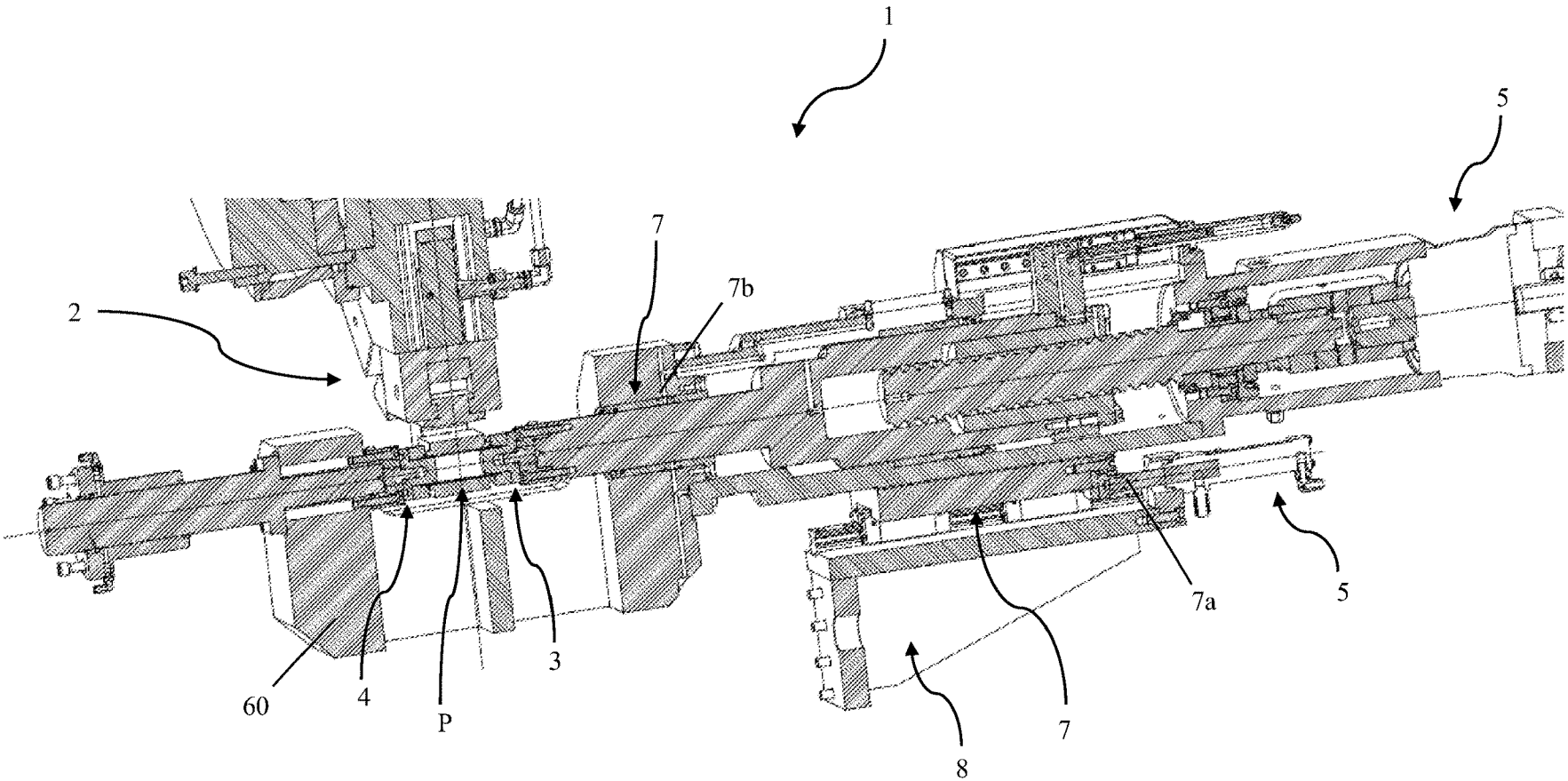
FIG. 5 shows a perspective view of the apparatus in FIG. 1 in an operating configuration thereof.
Figure 6:
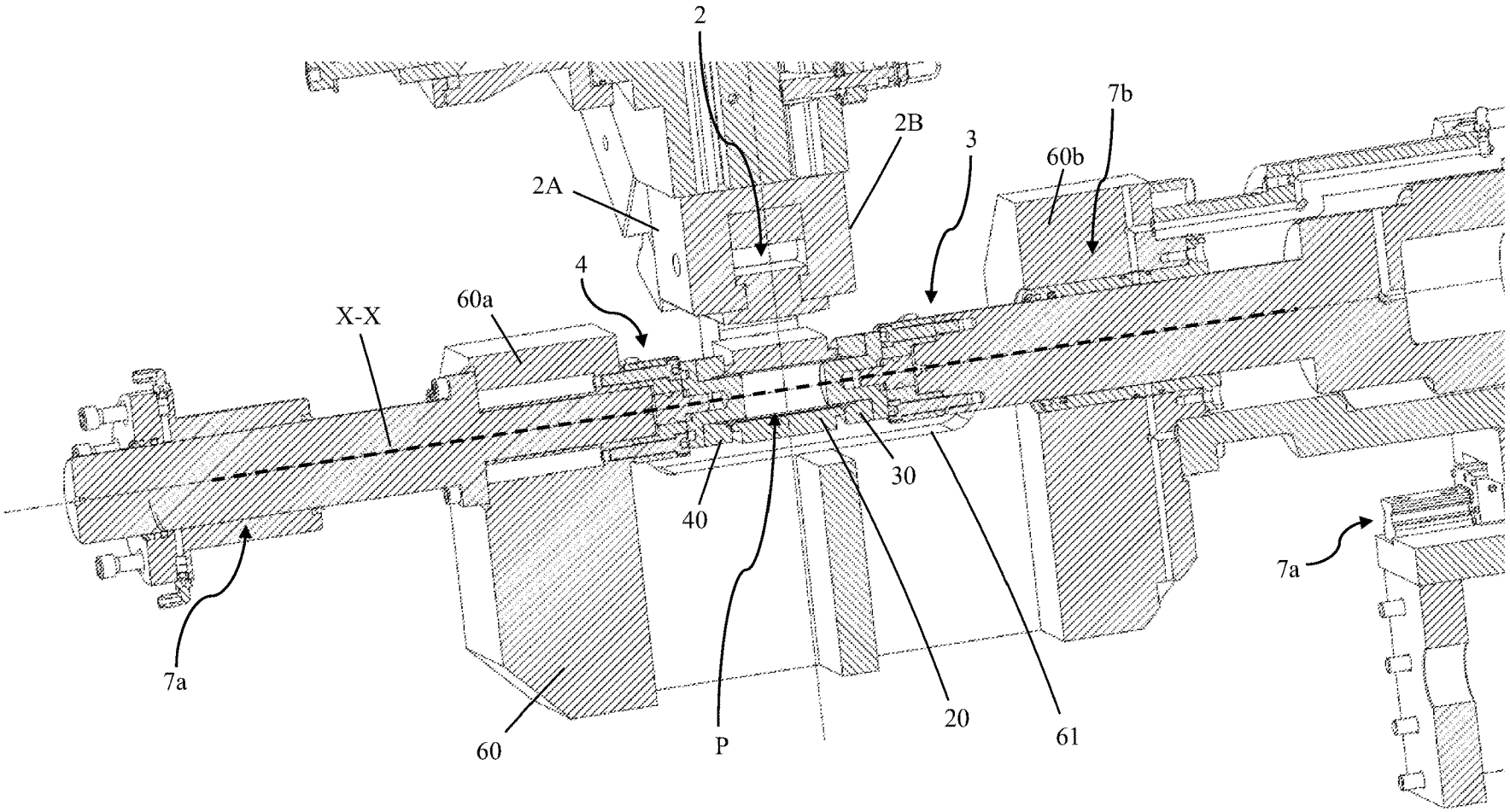
FIG. 6 shows a magnification of FIG. 5 to better highlight some technical details.
Figure 7:
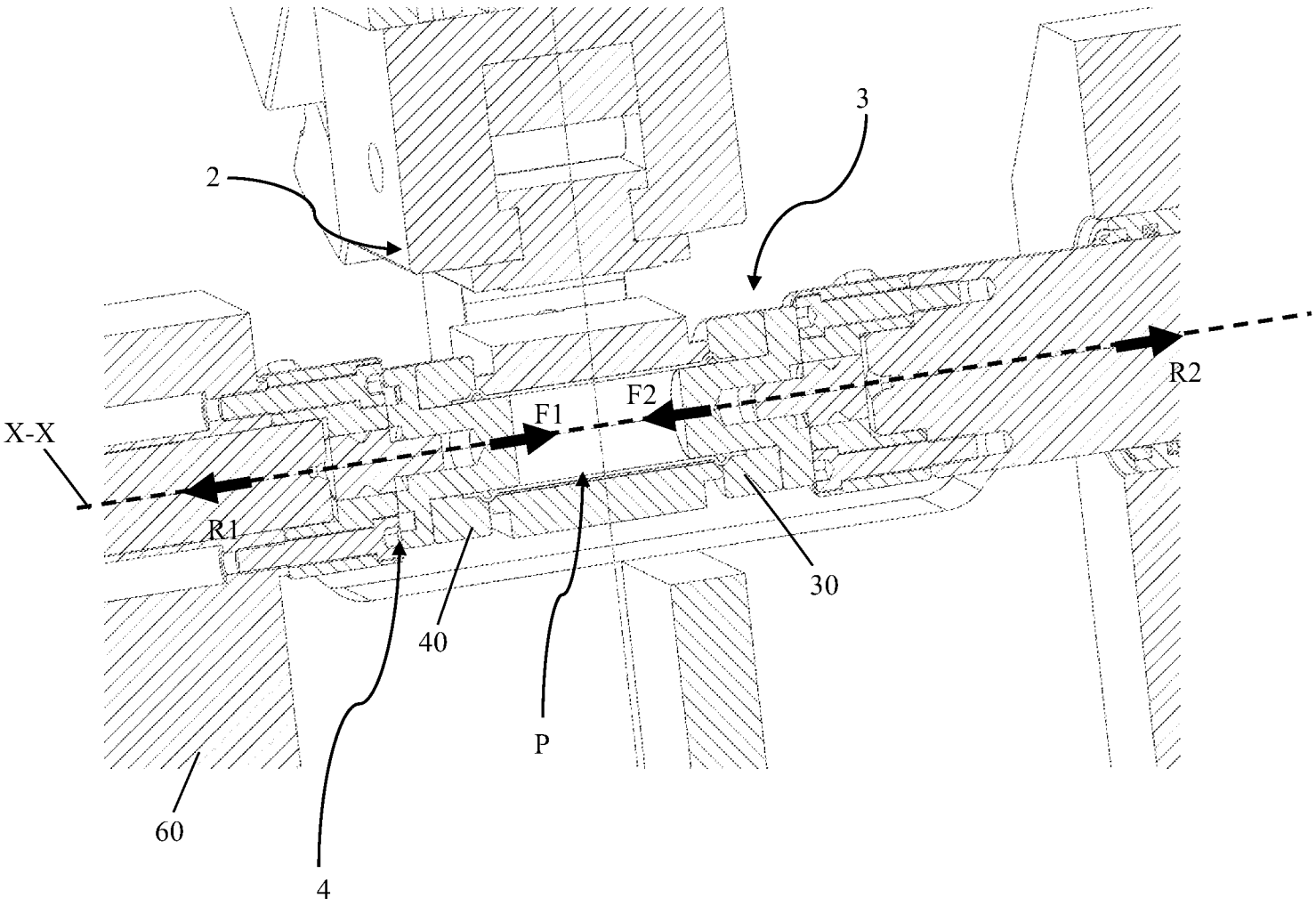
FIG. 7 shows a magnification of FIG. 6.

With reference to FIGS. 5-7, in the operating position the first and second punches 3, 4 push the workpiece P from opposite sides along the direction of action X-X by exerting the pair of compression forces F1, F2.

It should be specified that the pair of compression forces F1, F2 are directed in opposite verses along the same direction of action X-X. Preferably, the pair of compression forces F1, F2 are equal in modulus.

With reference to FIGS. 1 and 2, in the resting position the first and second punches 3, 4 are not in contact with the workpiece P and therefore do not exert any compression force on it.

Preferably, in the operating position the first and second punches 3, 4 are located at the first and second sides 2A, 2B of the support unit 2 along the direction of action X-X, while in the resting position they are spaced apart from the first and second sides 2A, 2B of the support unit 2 along the direction of action X-X.

It should be specified that if the apparatus 1 is used for assembling components, the pair of compression forces F1, F2 is used to achieve the coupling of the components to be assembled, which does not necessarily imply their plastic deformation. For example, the compression forces F1, F2 can be employed to clamp a shaft in a respective bore by performing interference coupling.

In addition, it should be specified that in the case where the apparatus 1 is employed for assembling components, the first and second punches 3, 4 exert the compression forces on respective distinct components so as to assemble them along an assembly direction coinciding with the direction of action X-X of the punches 3, 4. The components to be assembled may, for example, both be supported by the support unit 2 or one by the support unit 2 and the other arranged between the support unit and a punch 3, 4 or both mounted on a respective punch 3, 4.

With reference to FIGS. 1-7, the apparatus 1 comprises actuation members 5 configured to control the movement of the first and second punches 3, 4 from and toward the support unit 2 along the direction of action X-X. In other words, the actuation members 5 are configured to switch the first and second punches 3, 4 between the operating and resting positions.

The actuation members 5 can act directly or indirectly on the movement of the punches 3, 4. More details on the actuation members 5 will be provided later in the disclosure.

The apparatus 1 further comprises a floating element 6 adapted to support the first and second punches 3, 4 from opposite sides of the support unit 2 along the direction of action X-X. In detail, the floating element is configured to arrange the first and second punches 3, 4 according to what is disclosed above and shown in the attached figures.

At least one punch 3, 4 is free to be moved along the direction of action X-X with respect to the floating element 6.

Preferably, according to what is shown in FIGS. 1-7, the second punch 4 is fixed to the floating element 6. In other words, the second punch 4 is constrained to the floating element 6, in particular along the direction of action X-X.

It should be noted that, according to the third principle of dynamics (action-reaction principle), the operating of the compression forces F1, F2 on the workpiece P generates on the floating element a pair of reaction forces R1, R2, opposite to compression forces F1, F2.

It should be noted that the term "opposite" means that the pair of reaction forces R1, R2 has the same modulus but opposite directions with respect to the compression forces F1, F2. The diagram of the forces is shown in FIG. 7.

In particular, the first and the second punch 3, 4 exert on the workpiece P, respectively, a first compression force F1 and a second compression force F2 opposite to the first compression force F1.

The first and second compression forces F1, F2 respectively generate a first reaction force R1 opposed to the first compression force F1, and a second reaction force R2 opposed to the second compression force F2. With reference to the force diagram shown in FIG. 7, the first and second reaction forces R1, R2 are discharged onto the floating element 6 acting along the direction of action X-X in opposite directions by pulling it. In particular, the reaction forces R1, R2 place in traction what is hereinafter defined as the main body 60 of the floating element 6. More details about this main body 60 will be provided in the following disclosure.

It should be noted that the floating element 6 is configured to receive and support the reaction forces R1, R2 which, by discharging on it, cancel out. Therefore, advantageously, the reaction forces R1, R2 are not discharged to the ground.

The floating element 6 is movable along the direction of action X-X of the first and second punches 3, 4, preferably with respect to the support unit 2.

In detail, in the embodiment shown in FIGS. 1-7, the apparatus 1 comprises first guide members 7*a* configured to allow the movement of the floating element 6 along the direction of action X-X. The first guide members 7*a* therefore allow the floating element 6 to be connected to a bearing element or base 8 ofthe apparatus 1 in translation along the longitudinal direction X-X.

With reference to FIG. 1, preferably, the actuation members 5 comprise first and second actuation members 5*a* configured to control the movement of the floating element along the longitudinal direction X-X.

According to one aspect the first actuation members 5*a* are therefore operatively associated with the first guide members 7*a*, i.e. their drive causes the sliding of the floating element 6 in the first guide members 7*a* along the longitudinal direction X-X.

In the embodiment shown in FIGS. 1-7, the first actuation members 5 are of the hydraulic type, i.e. they comprise a piston hydraulically actuated by a pressurized fluid. However, it should be specified that in alternative embodiments the first actuation members can be of the pneumatic or electric motorized type.

Preferably, the apparatus 1 further comprises second guide members 7*b* configured to allow the movement of at least one of the first and second punches 3, 4 with respect to the floating element 6.

In the embodiment shown in FIGS. 1-7, the second guide members 7*b* comprise a hole made in the floating element 6, configured to slide the first or second punch 3, 4 therein.

With reference to FIG. 1, preferably, the actuation members 5 comprise second actuation members 5*b* configured to move at least one of the first and second punches 3, 4 along the direction of action X-X with respect to the floating element 6.

According to one aspect the second actuation members 5*b* are operatively associated with the second guide members 7*b*, i.e. their drive causes at least one of the first and second punches 3, 4 to slide along the direction of action X-X with respect to the floating element 6.

In the embodiment shown in FIGS. 1-7, the second actuation members 5*b* comprise an electric motor adapted to drive the translation of the first punch 3 along the direction of action X-X by members of worm kinematics. However, in alternative embodiments, the second actuation members 5*b* can be of the hydraulic or pneumatic type.

According to the above, preferably, the floating element 6 comprises a main body 60 having a first portion 60*a* facing the first side 2A of the support unit 2, and a second portion 60*b* facing the second side 2B of the support unit 2. In detail, the first and second punches 3, 4 are respectively arranged on the first and second portions 60*a*, 60*b* of the main body 60.

According to one aspect, the main body 60 comprises a recess 61, interposed between the first and the second portion 60*a*, 60*b*, adapted to at least partially receive the support unit 2. In other words, during use, the workpiece P is disposed by the support unit 2 in the recess 61 so as to be interposed between the first and second portions 60*a*, 60*b* and facing opposite sides of the first and second punches 3, 4.

In the embodiment shown in FIGS. 1-7, the main body 60 has a U-shape.

If the apparatus 1 that is the object of the present invention is employed for mechanical machining by plastic deformation, the support unit 2 comprises a mould 20 adapted to receive the workpiece P.

In the context of the present invention, the term "mould" refers to equipment used in plastic deformation processing to shape the workpiece. In particular, it should be specified that the mould comprises a moulding portion having a geometry that is the negative of that required to be imprinted on the workpiece with the processing process.

In use, the compression forces F1, F2 exerted by the punches 3, 4 plastically deform the workpiece P which, coming into contact with the mould P, in particular with the moulding portion, assumes the desired geometry.

Preferably, the workpiece P has a prevalent extension along the direction of action X-X, in particular it is a tube, a duct or a fitting.

Furthermore, preferably, the mould 20 comprises a moulding portion configured to generate variable section pipes, in particular having shoulders adapted to allow a pressure connection with other pipes.

In one embodiment, at least one of the first and the second punch 3, 4 comprises a counter-mould 30, 40 configured to couple with the mould 20 of the support unit 2 when the first and the second punches 3, 4 are in the operating position.

Preferably, both punches include a counter-mould 30, 40.

It should be specified that the counter-mould 30-40 coupling with the mould 20 completes it by defining with the latter the geometry that is desired to be obtained with the plastic deformation processing.

The counter-moulds are particularly useful when it is desired to obtain annular bulges at the end of the workpiece P, according to what is shown in FIG. 7.

With reference to images 1-7, the operating phases of the apparatus 1 that is the object of the present invention will be disclosed below.

Initially, the apparatus 1 is in the resting position shown in FIGS. 1 and 2. In detail, in the resting position the workpiece P is interposed between the first and second punches 3, 4 which are spaced apart from this along the direction of action X-X.

The drive of the actuation members 5, in particular of the second actuation members 5*b*, moves the first punch 3 towards the first side 2A of the support unit 2 along the direction of action X-X until the latter abuts against a first end P1 of the workpiece P.

Figure 3:
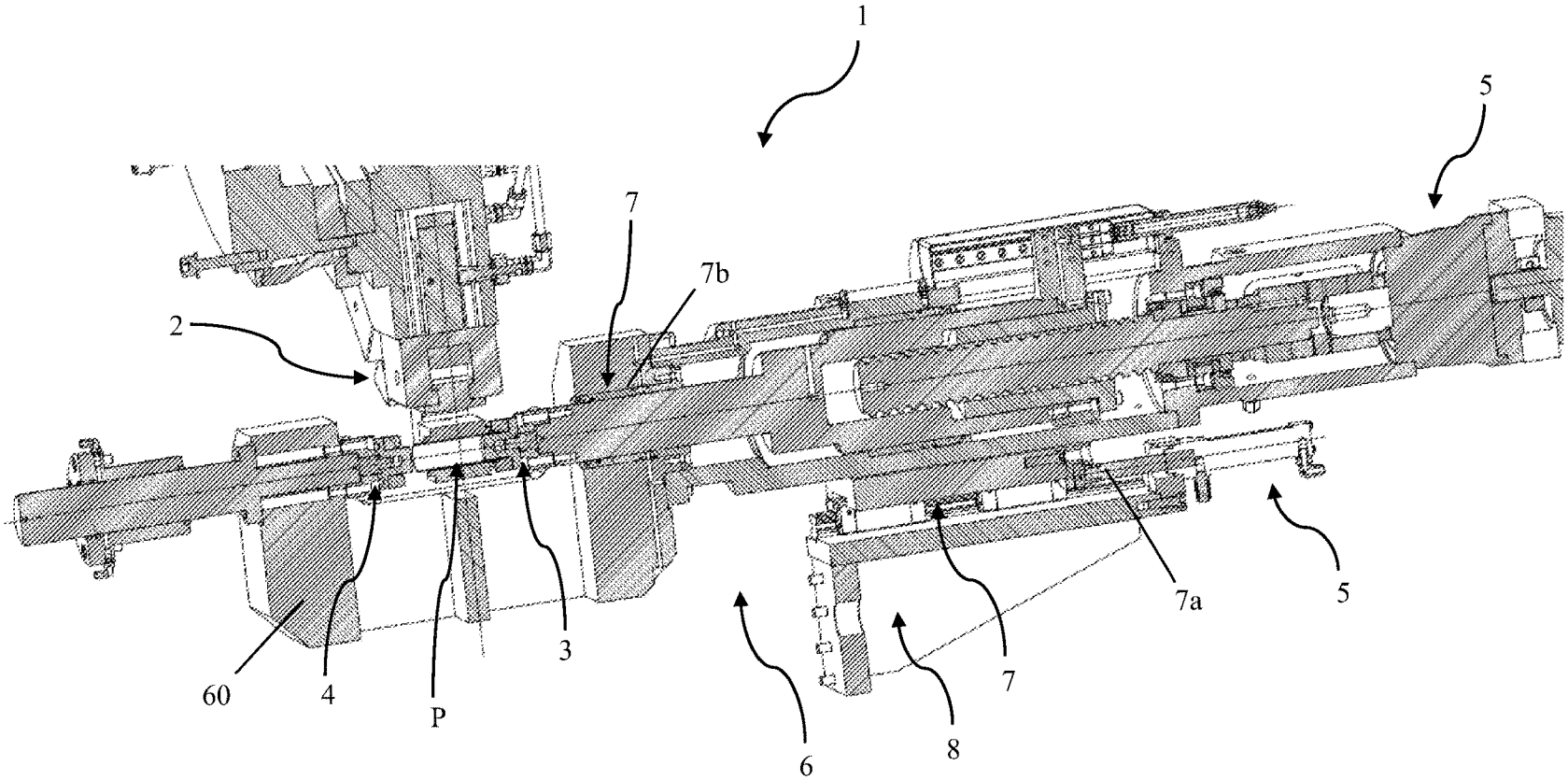
FIG. 3 shows a perspective view of the apparatus of FIG. 1 shown in a drag position mode.
Figure 4:
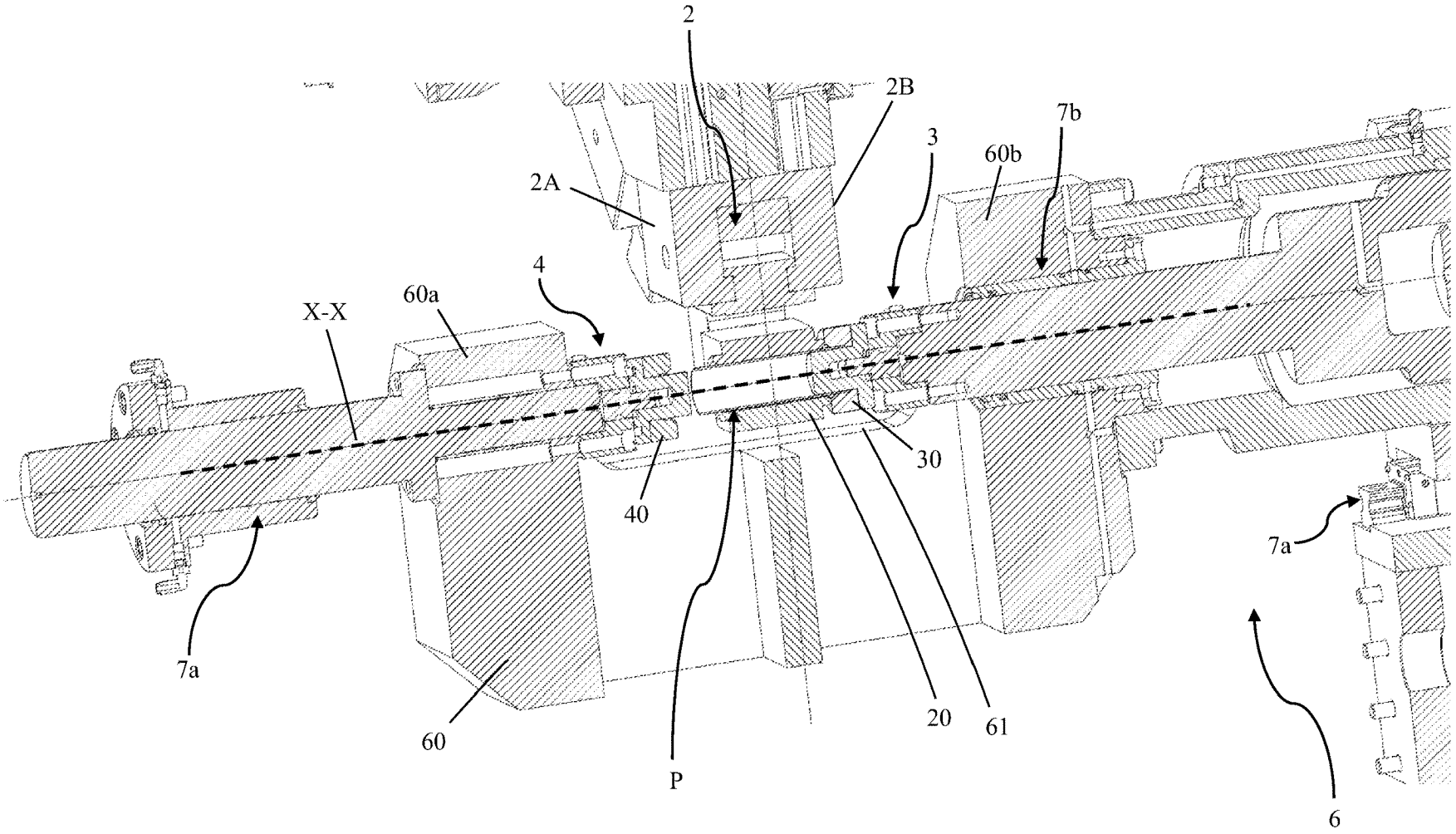
FIG. 4 shows a magnification of FIG. 3 to better highlight some technical details.

The apparatus 1 is thus brought from the resting position to the dragging position shown in FIGS. 3 and 4.

It should be specified that, in alternative embodiments of the present invention, the dragging position can be reached by moving the second punch 4 along the direction of action X-X towards the second side 2B of the support unit 2 so that the workpiece P abuts against a second end P2.

Once the dragging position is reached, the further drive of the actuation members in particular of the second actuation members 5*b*, causes the second punch 4 to be drawn towards the second side 2B of the support unit 2 so that both punches 3, 4 abut against the workpiece P from opposite sides along the direction of action X-X.

Preferably, the second punch 4 is recalled by means of a translation along the direction of action X-X of the floating element 6.

When both punches 3, 4 abut against the workpiece P from opposite sides, the apparatus 1 is in the operating position shown in FIGS. 5-7. Therefore, the further drive of the actuation members 5, in particular of the second actuation members 5*b*, generates the compression forces F1, F2 adapted to deform a workpiece P or to assemble a pair of components along the direction of action X-X according to the above.

The actuation members 5, in particular the first and second actuation members 5*b*, are then used to move the punches 3, 4 and the floating element 6 along the direction of action X-X to return the apparatus 1 to the resting position of FIG. 1. In other words, the punches 3, 4 are moved away from the supporting unit 2.

The object of the present invention is also a machine tool 100 that can be employed for mechanical machining by plastic deformation or for assembling operations of a pair of components to be assembled comprising the apparatus 1 disclosed above.

Figure 8:
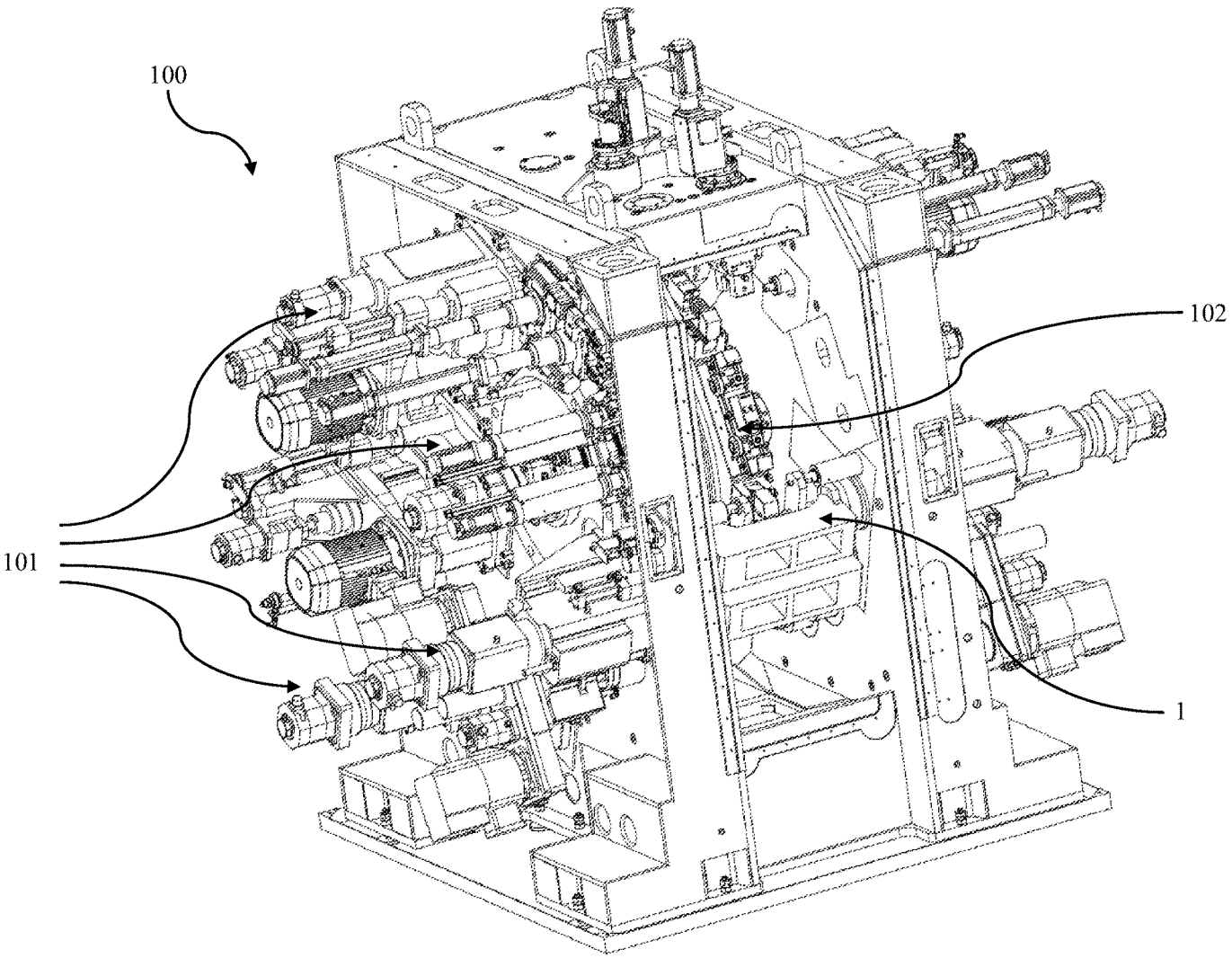
FIG. 8 shows a perspective view of a machine tool according to the present invention.
Figure 9:
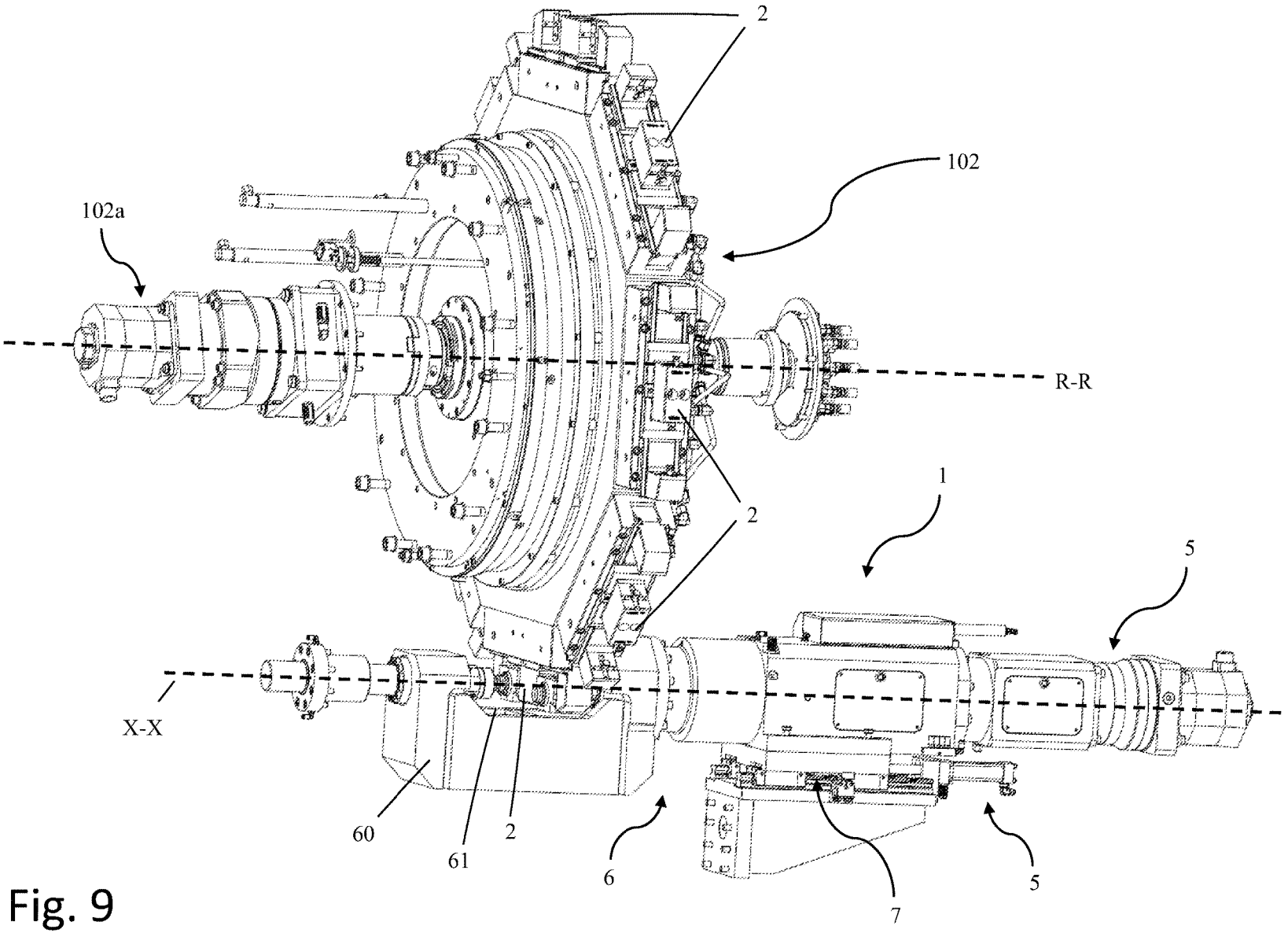
FIG. 9 shows a perspective view of the machine tool of FIG. 8 with some components removed to better illustrate others.

With reference to FIGS. 8 and 9, preferably, the machine tool 100 is of the automatic piece transfer type (transfer machine). In this regard it should be specified that in the context of the present invention, automatic piece transfer machine refers to a machine tool configured to combine, in a single production unit, the functions of a series of separate machine tools.

According to one aspect, the machine tool 100 comprises a plurality of processing stations 101 configured to perform respective mechanical operations or machining on a plurality of workpieces. Each piece, passing sequentially through the processing stations 101, performs a specific production cycle that transforms it into a finished product or a semi-finished product.

At least one of the processing stations 101 comprises the apparatus 1 disclosed above. Thus, at least one of the processing stations 101 is configured to perform mechanical machining for plastic deformation or component assembling operations.

With reference to FIGS. 8 and 9, preferably, said machine tool 100 comprises a support table 102 having a plurality of support units 2 that can be sequentially associated with the processing stations 101.

According to a possible embodiment of the machine tool 100, the support table 102 is configured to rotate around a rotation axis R-R and the processing stations 101 are arranged circumferentially with respect to the rotation axis R-R.

During use, the support table 102 is rotated by a motor 102*a*, preferably electrically driven, around the rotation axis R-R to sequentially associate the support units 2 to the processing stations 101.

Preferably, the direction of action X-X is oriented parallel to the axis of rotation R-R as shown in FIG. 9.

The invention claimed is:

1. Apparatus for mechanical machining by plastic deformation, comprising:

a support unit configured to support a workpiece;

a first punch and a second punch opposite each other and arranged on opposite sides of the support unit, the first punch and the second punch being movable from and toward the support unit along a direction of action to switch between an operating position in which exert compression forces on the workpiece adapted to plastically deform the workpiece and a resting position in which are spaced from the support unit, said compression forces generating reaction forces opposite to the compression forces;

actuation members adapted to control the movement of the first punch and of the second punch from and toward the support unit along the direction of action;

a floating element, movable along the direction of action, adapted to support the first punch and the second punch from opposite sides of the support unit along the direction of action, said floating element being configured to receive said reaction forces wherein the actuation members comprise first actuation members configured to move the floating element along the direction of action, and second actuation members configured to move at least one of the first punch and the second punch along the direction of action with respect to the floating element.

2. Apparatus according to claim 1, wherein the floating element is movable along the direction of action with respect to the support unit.

3. Apparatus according to claim 1 comprising first guide members configured to allow the movement of the floating element along the longitudinal direction, and second guide members configured to allow the movement of at least one of the first punch and the second punch with respect to the floating element along the longitudinal direction.

4. Apparatus according claim 1, wherein:

the support unit has a first side and a second side opposite the first side along the direction of action;

the floating element comprises a main body having a first portion facing the first side of the support unit, and a second portion facing the second side of the support unit, the first punch and the second punch being respectively arranged on the first portion and the second portion of the main body.

5. Apparatus according to claim 4, wherein the main body comprises a recess, interposed between the first portion and the second portion, adapted to at least partially receive the support unit.

6. Apparatus according to claim 4, wherein the main body is U-shaped.

7. Machine tool for mechanical machining by plastic deformation comprising at least one apparatus for mechanical machining by plastic deformation, said apparatus comprising:

a support unit configured to support a workpiece;

a first punch and a second punch opposite each other and arranged on opposite sides of the support unit, the first punch and the second punch being movable from and toward the support unit along a direction of action to switch between an operating position in which exert compression forces on the workpiece adapted to plastically deform the workpiece and a resting position in which are spaced from the support unit, said compression forces generating reaction forces opposite to the compression forces;

actuation members adapted to control the movement of the first punch and of the second punch from and toward the support unit along the direction of action;

a floating element, movable along the direction of action, adapted to support the first punch and the second punch from opposite sides of the support unit along the direction of action, said floating element being configured to receive said reaction forces wherein the actuation members comprise first actuation members configured to move the floating element along the direction of action, and second actuation members configured to move at least one of the first punch and the second punch along the direction of action with respect to the floating element.

8. Machine tool according to claim 7, comprising:

a plurality of working stations configured to perform mechanical operations on a plurality of workpieces;

a support table comprising a plurality of support units sequentially associable to the working stations;

wherein at least one of the working stations comprises said apparatus for mechanical machining by plastic deformation.

9. Machine tool according to claim 8, wherein:

the support table is configured to rotate around a rotation axis to sequentially associate the support units to the processing stations;

the direction of action is oriented parallel to the rotation axis.

10. Apparatus for mechanical machining by plastic deformation, comprising:

a support unit configured to support a workpiece;

a first punch and a second punch opposite each other and arranged on opposite sides of the support unit, the first punch and the second punch being movable from and toward the support unit along a direction of action to switch between an operating position in which exert compression forces on the workpiece adapted to plastically deform the workpiece and a resting position in which are spaced from the support unit, said compression forces generating reaction forces opposite to the compression forces;

actuation members adapted to control the movement of the first punch and of the second punch from and toward the support unit along the direction of action;

a floating element, movable along the direction of action, adapted to support the first punch and the second punch from opposite sides of the support unit along the direction of action, said floating element being configured to receive said reaction forces;

wherein the support unit comprises a mould in which the workpiece can be inserted, the first punch and the second punch being configured to exert said compression forces on the workpiece to plastically deform the workpiece against the mould;

wherein at least one of the first punch and the second punch comprises a counter-mould configured to couple with the mould of the support unit when the first and the second punch are in the operating position.

* * * * *